US007223161B2

(12) United States Patent
Kodani et al.

(10) Patent No.: US 7,223,161 B2
(45) Date of Patent: May 29, 2007

(54) CUTTING APPARATUS WITH DUST DISCHARGING

(75) Inventors: Mitsunori Kodani, Hiroshima (JP); Kazumasa Tachibana, Hiroshima (JP)

(73) Assignee: Goei Co., Ltd., Hiroshima (JP)

( * ) Notice: Subject to any disclaimer, the term of this patent is extended or adjusted under 35 U.S.C. 154(b) by 298 days.

(21) Appl. No.: 10/966,066

(22) Filed: Oct. 18, 2004

(65) Prior Publication Data

US 2005/0287938 A1 Dec. 29, 2005

(30) Foreign Application Priority Data

Jun. 29, 2004 (JP) ..... 2004-192075
Jun. 29, 2004 (JP) ..... 2004-192076

(51) Int. Cl.
*B24B 23/00* (2006.01)

(52) U.S. Cl. ..... 451/354; 451/359; 451/451; 451/456

(58) Field of Classification Search ..... 451/344, 451/350, 351, 352, 353, 354, 355, 356, 357, 451/358, 359, 451, 452, 456, 457, 488; 30/390
See application file for complete search history.

(56) References Cited

U.S. PATENT DOCUMENTS 1,643,882 A * 9/1927 Faiver ..... 15/28
3,256,648 A * 6/1966 Subonovich ..... 451/456
3,673,744 A * 7/1972 Oimoen ..... 451/353
3,935,678 A * 2/1976 Marton ..... 451/359
3,964,212 A * 6/1976 Karden ..... 451/358
4,135,334 A * 1/1979 Rudiger ..... 451/456
4,622,782 A * 11/1986 Roestenberg ..... 451/456
5,713,785 A * 2/1998 Nishio ..... 451/451
5,993,305 A * 11/1999 Chu ..... 451/357
6,027,399 A * 2/2000 Stewart ..... 451/353

FOREIGN PATENT DOCUMENTS

DE 1 289 450 2/1969
DE 31 09 007 A1 9/1982
JP 2000-210866 8/2000

* cited by examiner

*Primary Examiner*—Timothy V. Eley
(74) *Attorney, Agent, or Firm*—Squire, Sanders & Dempsey L.L.P.

(57) ABSTRACT

In a cutting apparatus having a circular blade with a dust discharging unit for, during cutting, discharging chips (dust) within a dust cover covering the circular blade, a pulley is fixed to an output shaft of a power source, and a flat belt for transmitting power to the dust discharging unit is engaged with the pulley. The pulley and the flat belt are covered with an inner cover within the dust cover. The inner cover has a through hole for allowing the output shaft to protrude the inner cover therethrough with a seal made of felt to prevent dust from entering the inside of the inner cover. A surface touching member is provided around an opening edge of the dust cover movable along an axial direction of the output shaft by spring-loading, which automatically reduces the gap between the dust cover and the object to prevent dust from being scattered.

10 Claims, 9 Drawing Sheets

CUTTING APPARATUS WITH DUST DISCHARGING

FIELD OF THE INVENTION

The present invention relates to a cutting apparatus used for at least one of cutting and grinding of an object to be cut, such as concrete blocks and stone works, and particularly to hand-held cutters for cutting an object and to a hand-held sander for grinding an object.

BACKGROUND OF THE INVENTION

Cutting apparatuses including a circular blade (disk cutter) for cutting objects and sanders for grinding a surface of an object such as concrete blocks are known. Japanese Laid-open patent application publication No. 2000-210866 discloses such a sander (see pages 1 to 2, FIGS. 1–2). This conventional sander is used in such a manner that one side of rotating cutting edges of a circular blade is pressed on the surface of the object. The sander mainly includes a body having a driving power source for a circular blade (disc cutter), a cutting unit, mounted on the body, having the circular blade, a dust cover (chip guard) for covering the circular blade, and a dust discharging unit (chip discharging unit) attached to the cutting unit for sucking chips (dust) in the dust cover and externally discharging the dust.

More specifically, in this prior art, the dust cover is fixed to a lower part of the body with screws or the like, and an output shaft of a drive power source protrudes into the dust cover to provide a mounting structure for detachably mounting the circular blade on output shaft within the dust cover. The dust cover is at an opening edge thereof provided with a brush. When edges of the circular blade are pressed to the surface of an object, the brush closes an open space between the surface of the object and the brush. This prevents chips (dust) from being scattered. Thus, the chips are discharged to a predetermined dust collecting bag (filter) by the dust discharging unit without scattering.

However, in the structure of the sander disclosed in Japanese Laid-open patent application publication No. 2000-210866, because the pulley and the flat belt is exposed to the inside of the dust cover, there is a problem that the fine chips (powder dust) within the dust cover may stick to these members, which can cause slippage therebetween.

Further, since the bodies and the circular blades are general members, there are various types of products having various configurations on market. On the other hand, due to a lack of compatibility, the dust cover is typically specially designed for each type of the sander.

In the dust cover disclosed in Japanese Laid-open patent application publication No. 2000-210866, there is a problem that the heights of the dust covers from the body to the edge portion are the same, so that there is no compatibility with other circular blades (disk cutters) having different sizes.

SUMMARY OF THE INVENTION

One aspect of the present invention provides a cutting apparatus comprising a dust cover and a dust discharging unit for sucking chips (dust particles) within the dust cover (chip guard), further comprising an inner cover for covering a pulley and belt for transmitting power at an output shaft, connectable to a circular blade, of the cutting apparatus to the dust discharging unit attached. Further, a gap between the output shaft side and a through hole allowing the output shaft or the like to protrude from the inner cover is sealed with a seal member comprising felt.

This structure can prevent fine chips (powder dust) from sticking to the flat belt or the pulley. The sealing member is made of felt with (1) a higher flexibility than the case, such as rubber or plastic, so that it has a superior sealing characteristic because a contact part with a peripheral surface of the output shaft or the rotation member tends to be fit to a configuration of this peripheral surface. Further, this structure provides (2) heat resistance against rotation friction, and (3) resistance to wear against the rotation friction.

According to the present invention, sticking of dust to the flat belt or the pulley within the dust cover can be prevented. This can also provide a high durability to the seal member.

A further aspect of the present invention provides a hand-held cutting apparatus comprising: a body including a driving power source having an output shaft coupled to the driving power source; a cutting unit comprising; mounting means for detachably mounting a circular blade (disk cutter) on the output shaft; and a dust cover including an opening edge facing an object of cuts for covering the circular blade and the mounting means; a dust discharging unit attached to the cutting unit for sucking dust particles within the dust cover and externally discharging the dust particles; and an adjusting mechanism including a contact edge member contactable with an object of cuts around an opening edge of the dust cover for making the contact edge member automatically movable along an axial direction of the output shaft in accordance with a pushing reaction force received from the object as a result of pushing the cutting apparatus on the object.

According to the sander with the structure mentioned above as a cutting apparatus, preferably, the adjusting mechanism automatically absorbs the difference in height between the dust cover side and the circular blade side. Thus, the dust cover having a specific design can fit bodies and circular blades having a plurality of different heights.

The adjusting mechanism may comprise a surface touching member, including the contact edge, movable along an axial direction of the output shaft and a pushing mechanism for always pushing the grounding member toward a side of the object. The pushing member may comprise a structure reciprocally movable in accordance with a relation in magnitude between a pushing force of the pushing member and the pushing reaction force from the object.

According to the sander with this structure, the adjusting mechanism has a simple structure, so that a low cost sander is provided because of ease in assembling.

A further aspect of the present invention provides a cutting apparatus comprising: a pulley fixed to the output shaft engaged with a flat belt for transmitting power to the dust discharging unit; and an adjuster ring (cylinder) fixed to the output shaft for adjusting a height of the circular blade. The adjuster ring has a diameter larger than that of the pulley, wherein a difference in the diameter between the adjuster ring and the pulley functions as a guard for preventing the flat belt from detaching from the pulley.

According to the sander having this structure, a simple sleeve member without the guard can sufficiently operate as a pulley having a guard. For example, if the pulley is formed as a metal member subjected to a cutting process, a guard-making process is unnecessary, and thus the manufacturing process can be simplified because the adjuster ring has a diameter larger than that of the pulley.

A further aspect of the present invention provides the cutting apparatus further comprising a spacer provided between the body and the dust cover to prevent interference between the part of the dust discharging unit and the body. A part of the dust discharging unit may be arranged adjacent to a side of the body. Thus, the position of the body in height can be made different from the position of the part of the dust discharging unit, which can prevent interference therebetween. In general cutting processes, it is not common to change the body with respect to the same dust cover. Thus, the structure with the spacer does not largely affect the efficiency of the cutting process.

BRIEF DESCRIPTION OF THE DRAWINGS

The object and features of the present invention will become more readily apparent from the following detailed description taken in conjunction with the accompanying drawings in which.

DETAILED DESCRIPTION OF THE INVENTION

Figure 1:
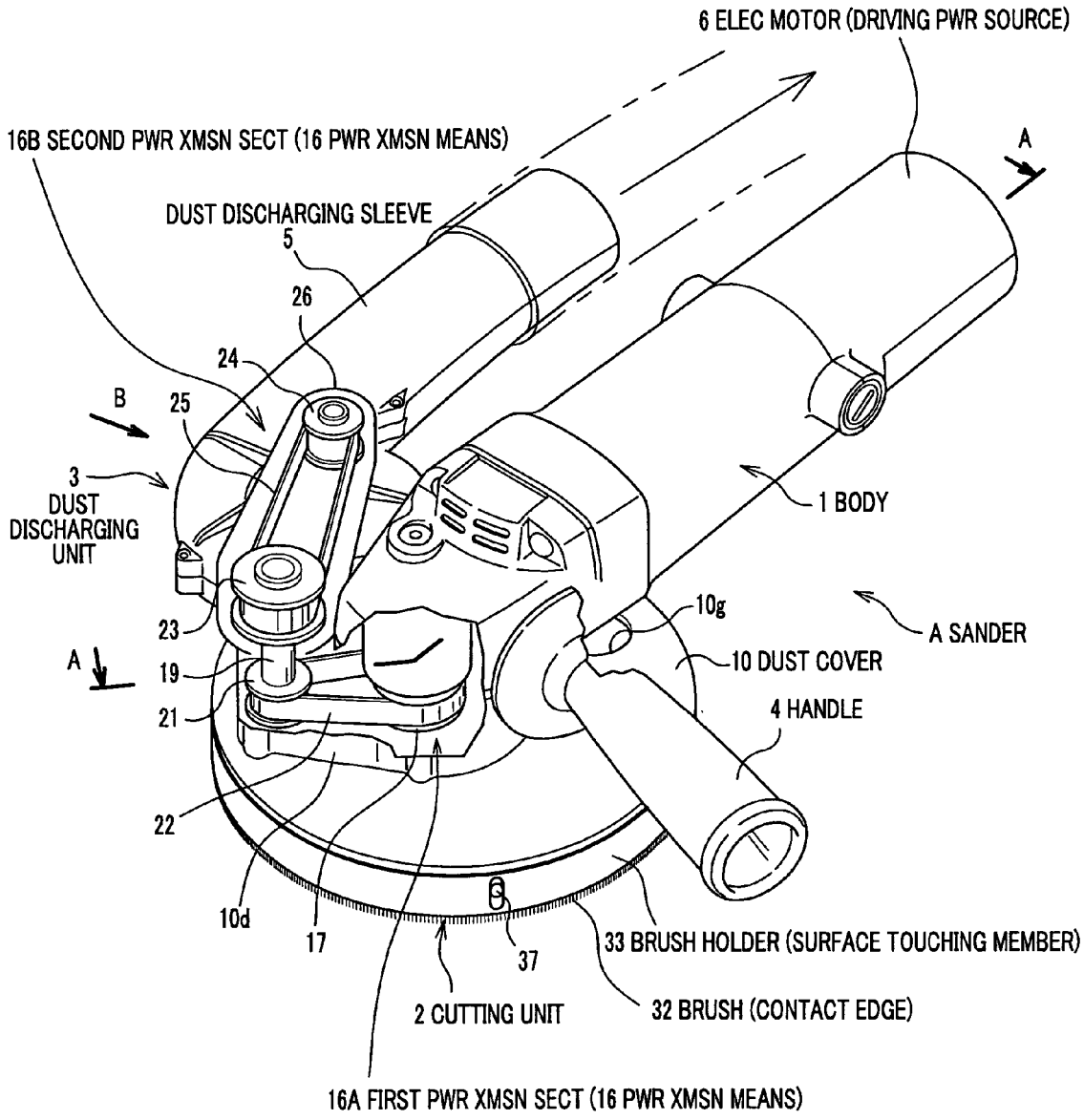
FIG. 1 is a perspective view, partially a cutaway view, of a sander according to the present invention.

Prior to describing embodiments of the present invention, the prior art described earlier will be further explained.

In the sander having the structure described previously, it is desired that a dust cover having one set of design dimensions (the same height) can fit bodies or circular blades having a plurality of specifications in dimension in consideration of management of products and costs. In other words, in a sander, its dust cover is required to fit bodies or circular blades manufactured by other makers. However, actually, in the conventional sanders, the length of the output shaft of a driving source may be different from those of other sanders, and the height (dimension along the axial direction of the driving source) of the circular blade of one sander may be different from those of other sanders. More specifically, if there is a difference in height between the tips of the circular blade and the opening edge (an edge of the opening) of the dust cover of the sander, there is a problem that the difference cannot be readily adjusted.

In this case, a countermeasure may be considered, in which a spacer for adjusting the height is provided around the output shaft. However, in this case, the structure around the mounting member of the disk cutter becomes complicated and the corresponding space is required. Further, for example, every exchange between circular blades having different heights along the output shaft correspondingly requires a spacer replacement operation. This decreases the cutting operation efficiency.

The present invention is provided to resolve the above-mentioned problems and to provide a sander capable of fitting cutters having different heights in the axial direction of the output shaft of a driving source. More specifically, there is provided a hand-held cutting apparatus comprising an adjusting mechanism comprising a contact edge member contactable with an object of cuts around an opening edge of the dust cover for making the contact edge member movable along an axial direction of the output shaft in accordance with a reaction force received from the object in accordance with pushing force of the cutting apparatus onto the object.

In the structure of the sander disclosed in Japanese Laid-open patent application publication No. 2000-210866, the pulley and the flat belt are exposed to the inside of the dust cover, chip particles (powder dust) within the dust cover may stick to these members and thus causes slippage between the pulley and the flat belt. To overcome this problem, for example, a structure may be considered in which another dust cover is separately provided for covering only the pulley and the flat belt.

However, in this structure, the pulley is also fixed to the output shaft for supporting the circular blade and thus, to cover the pulley, a through hole should be formed to allow the output shaft or a rotation member fixed to the output shaft to protrude from the cover. This structure is problematic because a gap between the dust cover and the output shaft may allow the powder dust to enter the side of the pulley.

The present invention is provided to solve such a problem. More specifically, the present invention provides, in a cutting apparatus comprising a pulley mounted on an output shaft within the dust cover and a flat belt partially wrapped around the pulley, a cutting unit capable of efficiently preventing the powder dust from sticking to these members.

In other words, there is provided a hand-held cutting apparatus comprising a dust cover, a dust discharging unit, a pulley fixed to the output shaft engaged with a flat belt for transmitting power to the dust discharging unit. An inner cover includes a through hole allowing at least one of the output shaft and a rotation member fixed to the output shaft to protrude from the inner cover through the though hole, arranged in the dust cover, for contactlessly covering the flat belt and the pulley. A seal comprises felt for sealing a gap between at least one of the output shaft and the rotation member and the through hole, to prevent the dust particles from entering the side of the pulley.

Two embodiments will be described. A first embodiment describes the cutting apparatus as a sander mainly used for sanding a surface of an object such as a concrete surface. The second embodiment describes the cutting apparatus mainly used as a cutter for cutting an object, such as a concrete block, to have a groove therein.

Figure 2:
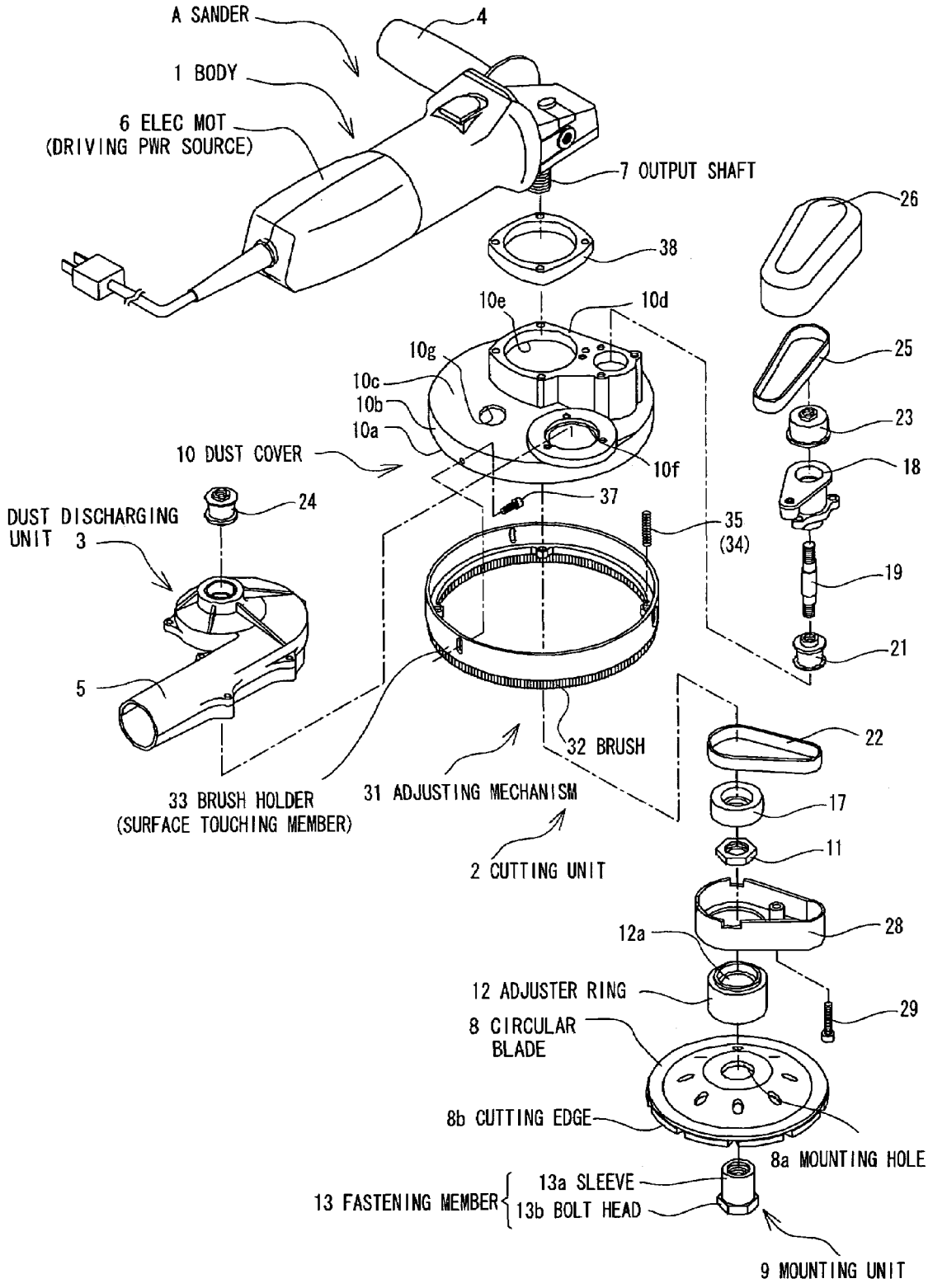
FIG. 2 is a perspective view of the sander in a de-assembled condition according to the present invention.
Figure 3:
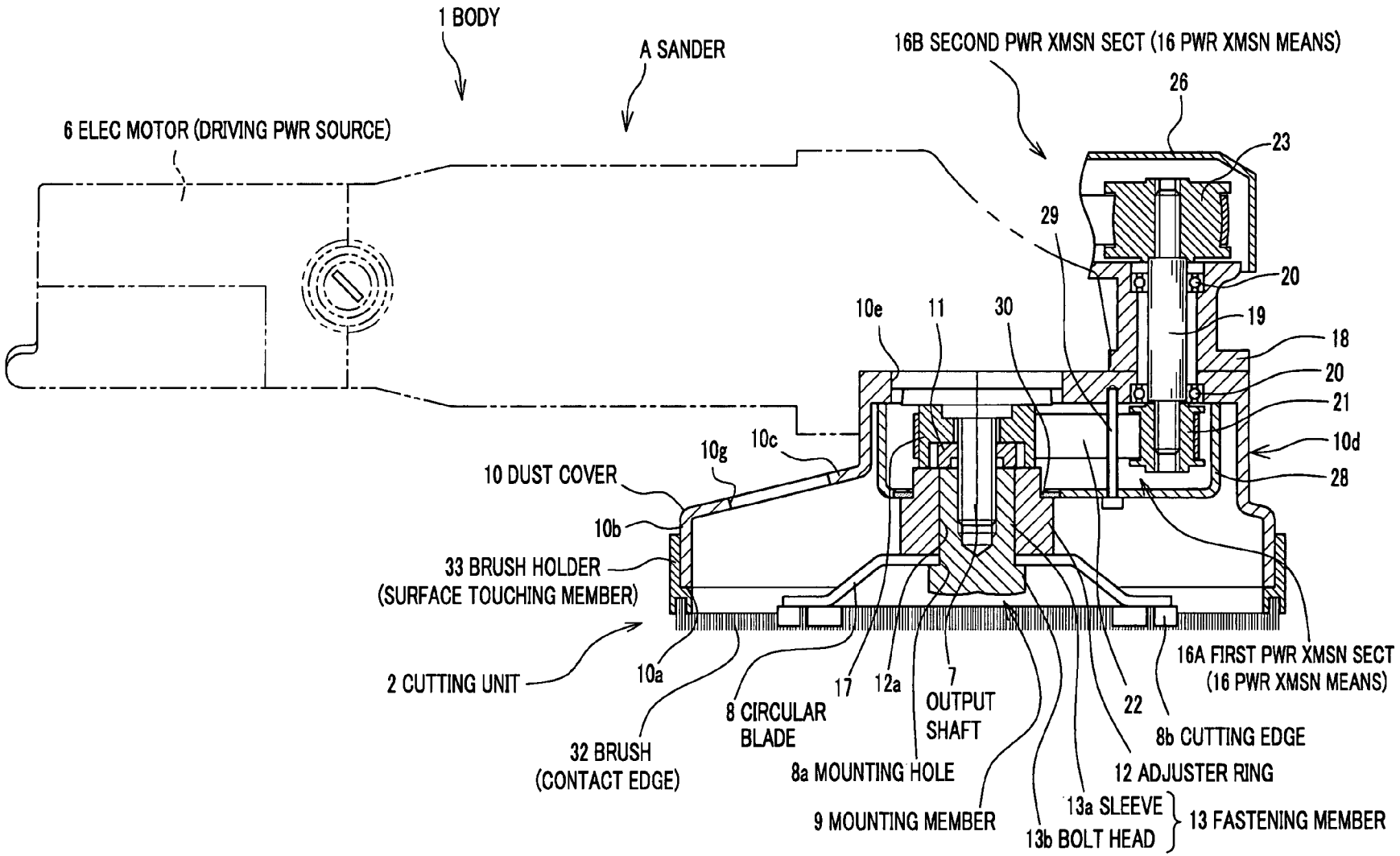
FIG. 3 is a side sectional view, taken along line A1—A1 in FIG. 1, mainly illustrating a body and a cutting unit.
Figure 4:
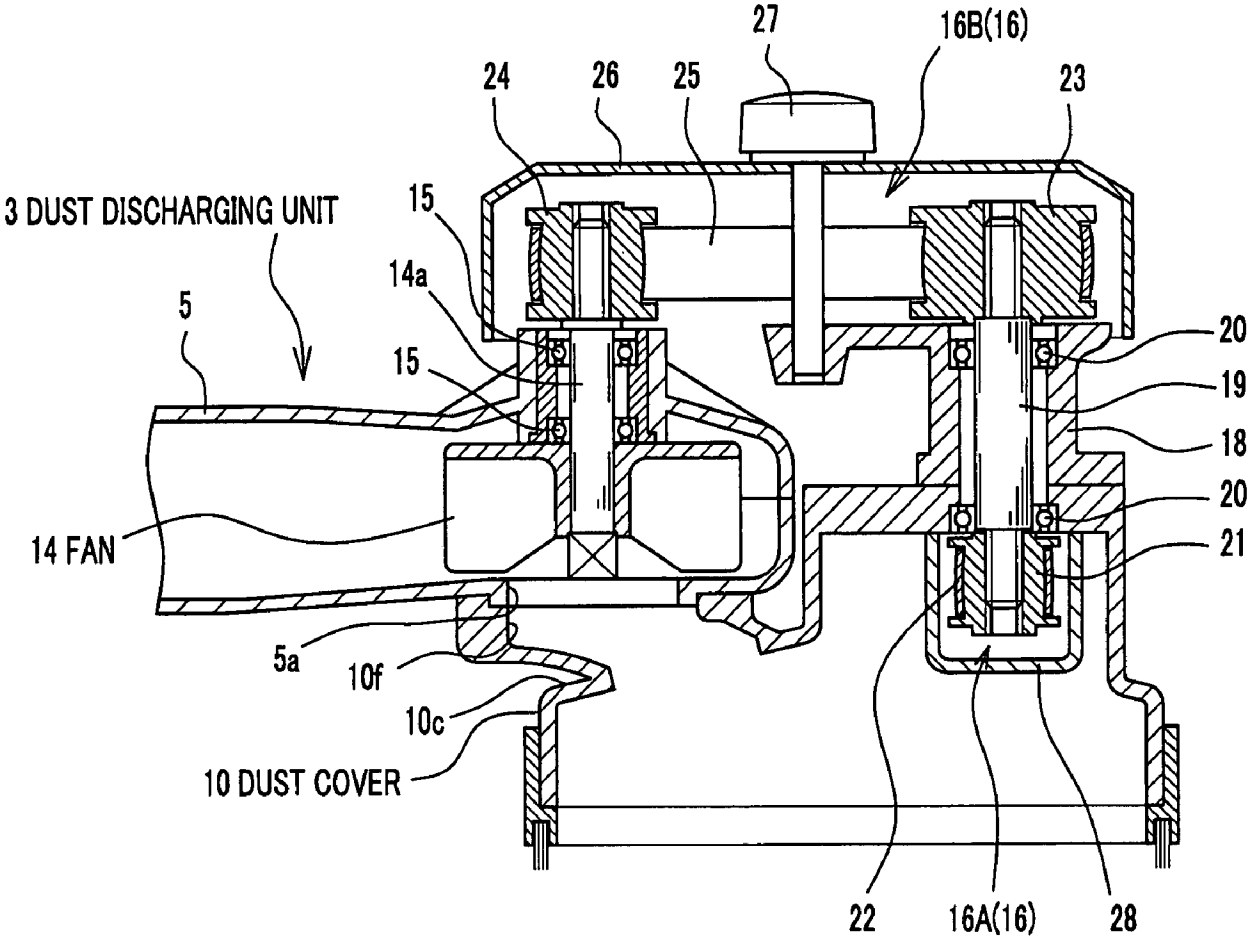
FIG. 4 is a side sectional drawing viewed from B in FIG. 1, mainly illustrating a dust discharging unit.
Figure 5:
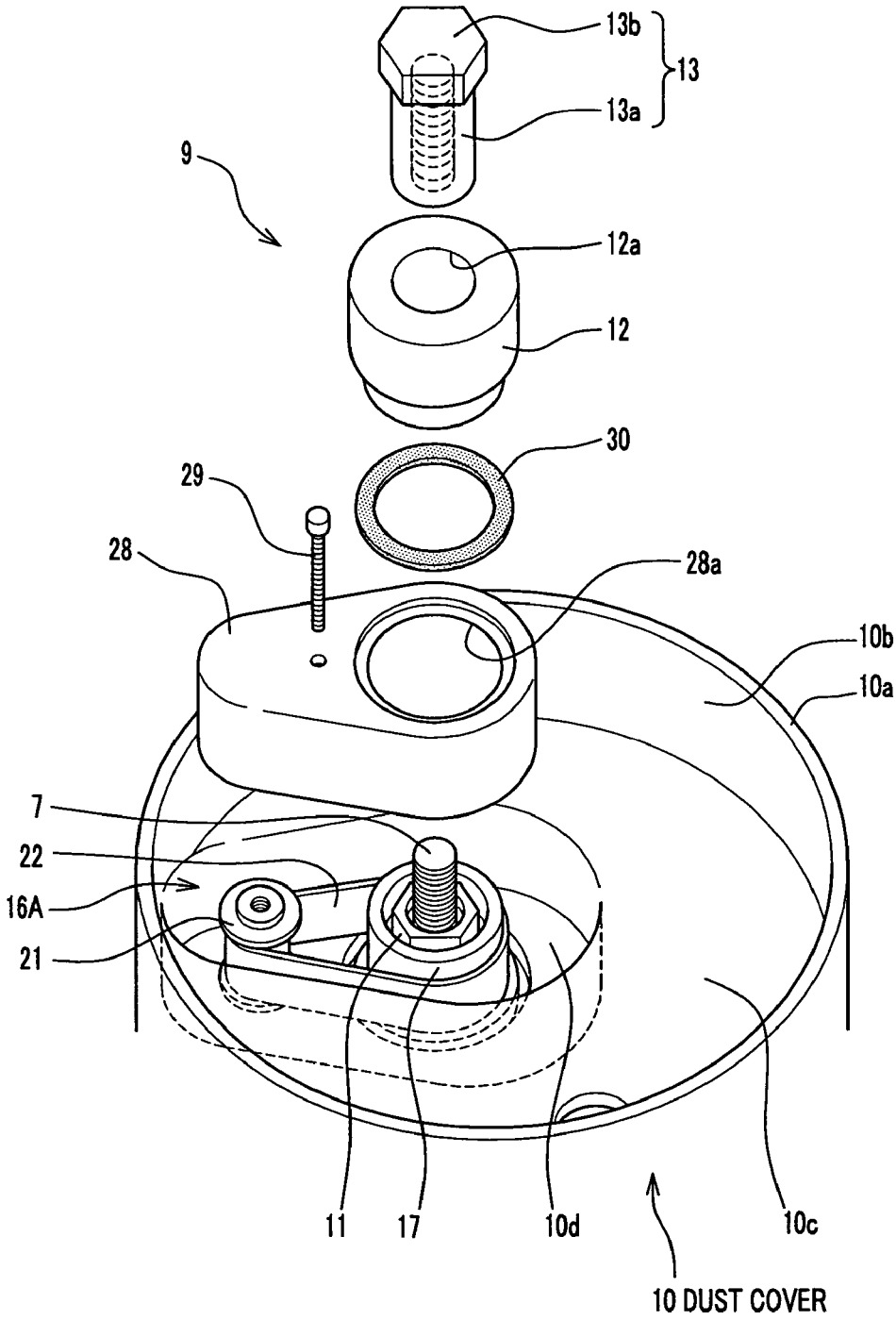
FIG. 5 is a partial perspective drawing viewed from a side of an opening of a dust cover of the sander according to the present invention, illustrating a first power transmission section.
Figure 6:
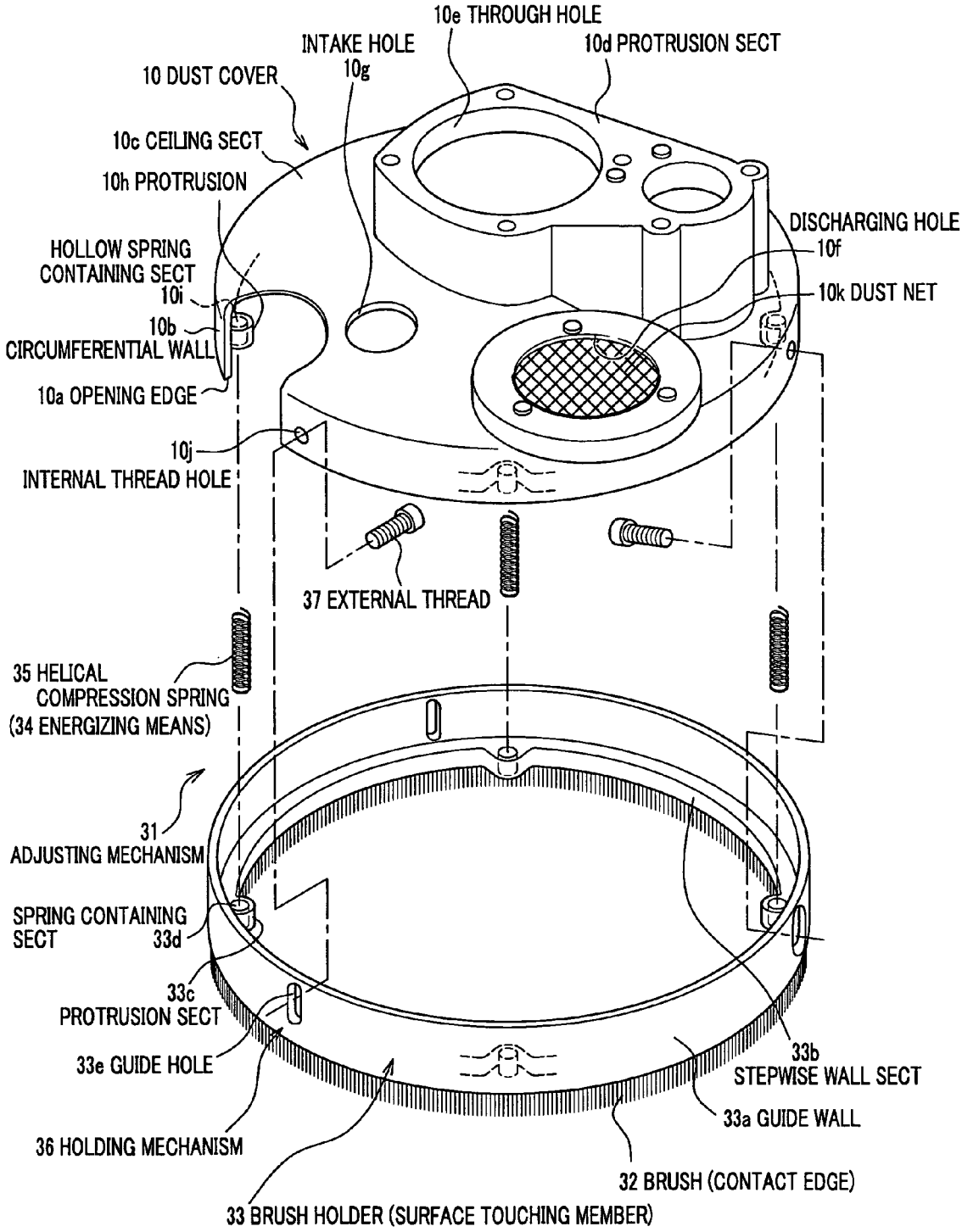
FIG. 6 is an enlarged view of an adjusting mechanism shown in FIG. 2.

FIGS. 1 to 7 are provided to describe the first embodiment. FIG. 1 is a perspective view, partially a cutaway view, of a sander. FIG. 2 is a perspective view of the sander in a de-assembled condition. FIG. 3 is a side sectional view, taken along line A1—A1 in FIG. 1, mainly illustrating a body and a cutting unit. FIG. 4 is a side sectional drawing viewed from B in FIG. 1, mainly illustrating a dust discharging unit. FIG. 5 is a partial perspective drawing viewed from a side of opening of a dust cover of the sander according to the present invention, illustrating a first power transmission section 16A. FIG. 6 is an enlarged view of an adjusting mechanism 31 shown in FIG. 2. FIG. 7A is a side sectional view illustrating the adjusting mechanism 31 of the sander according to the present invention before touching an object. FIG. 7B is a side sectional view illustrating the adjusting mechanism 31 of the sander according to the present invention during contact with the object.

First Embodiment

In FIG. 1, the hand-held sander A comprises a body 1, a cutting unit 2 mounted on an under part of one side of the body 1, and a dust discharging unit 3 attached or connected to the cutting unit 2 and arranged adjacent to a side of the body 1.

The body 1 is provided with a handle 4 to be gripped by an operator at the opposite side to the side of the body 1. The dust discharging unit 3 comprises a discharging sleeve 5 connected to a dust collecting bag (not shown). The body 1 comprises an electric motor 6 as a driving power source of the cutting unit 2 and an output shaft 7 connected or coupled to the electric motor 6.

Cutting Unit 2

Cutting edges 8*b* comprise carbide tools, grindstones, a diamond wheel, or the like. At a center of a top part of a circular blade (disk cutter) 8, a mounting hole 8*a* is formed for mounting the circular blade 8 on the output shaft 7.

The configuration of the circular blade 8 is not limited to that shown in the drawing. For example, the circular blade 8 may comprise an entirely flat plate. The dust cover 10 comprises a circumferential wall 10*b* upwardly extending from a circular opening edge 10*a*, a ceiling section 10*c* connected to an upper edge of the circumferential wall section 10*b*, formed in a conical configuration, and a protruding section 10*d*, protruding from the ceiling section 10*c*, extending from a peripheral of the center of the ceiling section 10*c* to a part of a peripheral edge of the ceiling section 10*c*. The circumferential wall 10*b*, the ceiling section 10*c*, and the protruding section 10*d* are integrally formed to provide the dust cover 10 by molding, for example, by casting aluminum alloy.

Around the center of the ceiling section 10*c*, on the upper surface of the protruding section 10*d*, a through hole 10*e* is formed to allow the output shaft 7 to enter the inside of the dust cover 10 through the through hole 10*e* when the dust cover 10 is fixed to an under part of the body 1 with bolts (not shown).

The output shaft 7 is processed to have an external thread to which a pulley 17, forming the first power transmission section 16A, is fixed with a nut 11.

Next, a mounting member 9 will be described, mainly referring to FIG. 3. The mounting member 9 comprises an adjuster ring (cylinder) 12 and a fastening member 13. The adjuster ring 12 is formed to have a through hole 12*a* extending vertically in the drawing. The adjuster ring 12 serves to adjust the position of the circular blade 8 in height relative to the dust cover 10 and is in contact with the lower end of the pulley 17. The fastening member 13 is inserted into the through hole 12*a* of the adjuster ring 12 from the lower side and comprises a sleeve section 13*a* provided at an upper end side with an internal thread and a bolt head 13*b* formed at the lower end of the sleeve section 13*a*.

An example of steps of installing the circular blade 8 on the output shaft 7 is as follows:

First, the upper end surface of the adjuster ring 12 is placed to come into contact with the lower end of the pulley 17. Then, the circular blade 8 is placed to come into contact with the lower end surface of the adjuster ring 12 with alignment between the mounting hole 8*a* with the through hole 12*a*. The sleeve section 13*a* of the fastening member 13 is inserted into the mounting hole 8*a* from the lower side of the mounting hole 8*a* to couple an internal screw to the external screw of the output shaft 7. Then, the bolt head 13*b* is rotated by a predetermined tool to be fixed to the output shaft 7, so that the circular blade 8 is pinched between the lower surface of the adjuster ring 12 and the bolt head 13*b*.

Discharging Unit 3

As shown in FIGS. 2 and 4, a discharging hole 10*f* is formed in the ceiling section 10*c* of the dust cover 10 to which the dust discharging unit 3 is attached with bolts or the like (not shown) so as to face the discharging hole 10*f*.

As shown in FIG. 4, the dust discharging section 3 is provided with a ventilation hole 5*a* facing the discharging hole 10*f* and comprises the discharging sleeve 5 fixed to the dust cover 10 and a fan 14 within the discharging sleeve 5 located just above the discharging hole 10*f*.

The fan 14 provides dust discharging means for sucking powder dust or dust particles within the dust cover 10 by rotation thereof to the discharging sleeve 5 through the discharge hole 10*f* and the ventilation hole 5*a* to discharge the powder dust or exhaust a air flow containing dust particles to the dust collecting bag. The fan 14 is at its rotation shaft 14*a* rotatably supported by the discharging sleeve 5 via a bearing 15.

Here, there may be a case that a concrete piece having a size of, for example, about several millimeters may exist within the dust cover 10. When this piece is sucked into the dust sleeve 5, it may generate a large noise because of hitting the fan 14 or may stop the rotation of the fan 14 due to the piece becoming pinched between the main wall of the discharging sleeve 5 and the fan 14. Then, at least one of the discharging hole 10*f* and the ventilation hole 5*a* is provided with a dust net to prevent the large dust pieces from entering the dust discharging unit 3.

In this embodiment, as shown in FIG. 6, a dust net 10*k* having a grid mesh is attached to the discharging hole 10*f*. The material of the dust net 10*k* is made of aluminum alloy, iron, or the like.

Making the size of the mesh of the dust net 10*k* too small may damage the original dust discharging function or may cause clogging at the dust net 10*k*. In this embodiment, as an example of the size, the mesh is made small down to about 3 mm square to such an extent that a dust particle having a dimension possible to stop the rotation of the fan 14 cannot pass therethrough.

Further, in accordance with other embodiments, instead of the structure in which the dust net 10*k* is mounted, at least one of the discharging hole 10*f* and the ventilation hole 5*a* may be formed to have a plurality of small holes to provide a function equivalent to the mesh of the dust net 10*k*.

Further, the dust cover 10 may be occasionally provided with an intake hole 10*g* as shown in FIG. 2. The intake hole 10*g* is a hole for preventing the dust cover 10 from sticking on a surface of the workpiece due to a negative pressure inside the dust cover 10. A flow of the air through the intake hole 10*g* suppresses generation of an excessive negative pressure.

Power Transmission Section

In this embodiment, the rotation force of the output shaft 7 is used as a rotation driving source for the fan 14.

Hereinafter, the power transmission section 16 from the output shaft 7 to a rotation shaft 14*a* of the fan 14 will be described.

As shown in FIG. 3, the power transmission means 16 comprises the first power transmission section 16A inside the dust cover 10, i.e., arranged inside the protrusion section 10*d* and a second power transmission section 16B arranged above and outside the dust cover 10 as shown in FIG. 4. Both power transmission sections 16A and 16B comprise mechanisms including combinations of flat belts and pulleys for the flat belts.

The first power transmission section 16A will be described. As shown in FIG. 3, the pulley 17 is fixed to the output shaft 7 with the nut 11. A bearing member 18 is mounted on the upper surface of the protruding section 10*d* of the dust cover 10, and rotatably supports a vertically arranged transmission shaft 19 through bearings 20. The lower part of the transmission shaft 19 extends into the inside of the protruding part 10*d* and is provided with a pulley 21 at the lower end in which an endless flat belt 22 is wrapped between the pulley 21 and the pulley 17 at the side of the output shaft 7.

A diameter of the upper end surface of the adjuster ring 12 that will be in contact with the lower end surface of the pulley 17 is set to have a larger diameter than that of the pulley 17. According to this structure, the difference in the diameter from the adjuster ring 12 to the pulley 17, i.e., a bump therebetween, functions as a guard for preventing dislocation or detachment of the endless belt 22.

As described above, in the structure comprising the pulley 17 engaged with the flat belt 22 for transmitting power to the dust discharging unit, i.e., the fan 14 (see FIG. 4) and the adjuster ring 12 for adjusting a position in height of the circular blade 8, the larger diameter of the adjuster ring 12 than that of the pulley 17 as a guard for preventing dislocation of the endless belt 22, allows the pulley 17 to have a simple sleeve member without an additional guard for the pulley 17.

Thus, for example, if the pulley 17 is provided as a metal member subject to a cutting process, this structure will eliminate a step in the cutting process, which simplifies the manufacturing process.

As shown in FIG. 4, in the second power transmission section 16B, a pulley 23 is fixed to an upper end of the transmission shaft 19, wherein an endless belt 25 of a flat belt is wrapped between the pulley 23 and the pulley 24 rotatably fixed to the upper end of the rotation shaft 14*a*. According to this structure, rotation force of the output shaft 7 is transmitted to the rotation shaft 14*a* of the fan 14 via the pulley 17 (see FIG. 3), the endless belt 22, the pulley 21, the transmission shaft 19, the pulley 23, the endless belt 25, and the pulley 24.

As mentioned above, in using the rotation force of the output shaft 7 as rotation power for the fan 14 in the dust discharging unit, the use of the pulleys 17, 21, 23, and 24 and the endless belts 22 and 25 for power transmission as the power transmission means 16 provides a simple structure to the sander A at a low cost.

Further, in this embodiment, as shown in FIGS. 2 and 3, around the opening edge 10*a* of the dust cover 10, an adjusting mechanism 31 is provided to make a contact edge member movable in an axial direction of the output shaft in accordance with the pressure reaction force from the object.

As shown in FIGS. 6 and 7, the adjusting mechanism 31 in this embodiment comprises a surface touching member (a brush holder 33) formed along the opening edge 10*a* of the dust cover 10 movable in an axial direction of the output shaft 7 with a brush 32 (contact edge member) and energizing means 34 for always pressing the brush holder 33 toward the object side (spring-loading).

In this embodiment, the opening edge 10*a* is formed to have a circle edge and thus, the brush holder 33 is also made in a ring form to fit to this by molding with plastic or the like.

The lower end of the brush holder 33 is provided with the brush 32 at its lower edge. The brush 32 provides a function of sealing for preventing dust from being externally scattered when an operator presses the sander A to a concrete surface during cutting operation and smoothes the movement of the sander itself along the concrete surface.

The brush holder 33 comprises a guide wall 33*a* formed along the circumferential wall 10*b* of the dust cover 10 and vertically extending. The brush holder 33 can move in a sliding manner along the axial direction of the output shaft 7 (see FIG. 7) with guidance by the circumferential wall 10*b* of the dust cover 10. In the structure as mentioned above, there are cases that the brush holder 33 is fit inside the circumferential wall 10*b* of the dust cover 10 and outside the circumferential wall 10*b*, respectively. The former allows powder dust within the dust cover 10 generated during cutting to enter a gap (sliding part) between the circumferential wall 10*b* and the guide wall 33*a*. Thus, there is a possibility of plugging in the gap which may disable the brush holder 33 from smoothly sliding. On the other hand, the latter can more reduce the entrance of the powder dust into the gap than that of the former case because the gap exists outside the dust cover 10. FIGS. 6 and 7 show the structure of the latter.

At the lower edge on the inner peripheral surface side of the guide wall 33*a*, a stepwise wall section 33*b* is annularly formed. The upper surface of the stepwise wall section 33*b* limits the upward movement of the brush holder 33 to the dust cover 10 by contact with the opening edge 10*a* of the dust cover 10.

The stepwise wall 33*b* is locally provided with protrusion sections 33*c* extending toward the center of the brush holder 33. The protrusion sections 33*c* are provided at a suitable interval in a circumferential direction of the brush holder 33. In this embodiment, the protrusion section 33*c* are arranged at four places, each being provided with a spring containing section 33*d* formed to have a hollow part upwardly opening.

On the other hand, on the inner surface of the circumferential wall 10*b* of the dust cover 10, protrusions 10*h* are formed at locations corresponding to the protrusions 33*c*, respectively, in which hollow spring containing sections 10*i* downwardly opening are formed, respectively.

The energizing means 34 of this embodiment comprises a helical compression spring 35 at its lower end internally fit into and supported by the spring containing section 33*d*, and the upper end is internally fit into the hollow spring containing section 10*i*.

A holding mechanism 36 for holding the brush holder 33 with respect to the dust cover 10 will be described. In the guide wall 33*a* of the brush holder 33, ellipses having major axes extending in the direction of the axis of the output shaft 7 (see FIG. 7) are formed with a suitable equi-distant interval in the circumferential direction (FIG. 6 illustrates a case that they are provided at three places).

At the positions corresponding to the guide holes 33 the circumference wall 10*b* of the dust cover 10 has external thread holes 10*j*. The brush holder 33 is fit to the outside of the circumferential wall 10 so as to overlap the guide holes 33*e* with the external thread holes 10*j*. In this condition, screwing external threads 37 into the internal thread holes 10*j* causes existence of tip sides of the external threads 37 within the guide holes 33*e*, so that the brush holder 33 is movably supported by the dust cover 10 without detaching.

In other words, the external threads 37 serve as engagement pins preventing the dust cover 10 from detaching from the dust cover 10. Further, the guide holes 33*e* and the external threads 37 provide a function for guiding the sliding movement of the brush holder 33 with respect to the dust cover 10 and a function for limiting movement in the circumferential movement.

Hereinafter, operation of the adjusting mechanism 32 will be described with reference to FIGS. 7A and 7B.

Figure 7A:
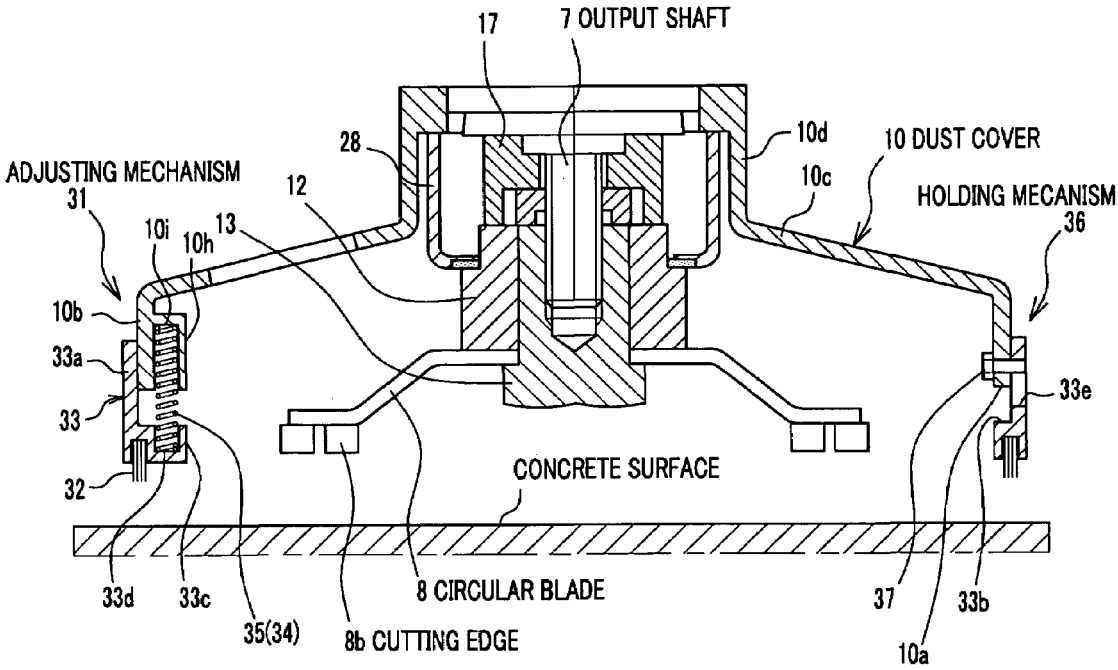
FIG. 7A is a side sectional view illustrating the adjusting mechanism of the sander according to the present invention before contact with workpiece.
Figure 7B:
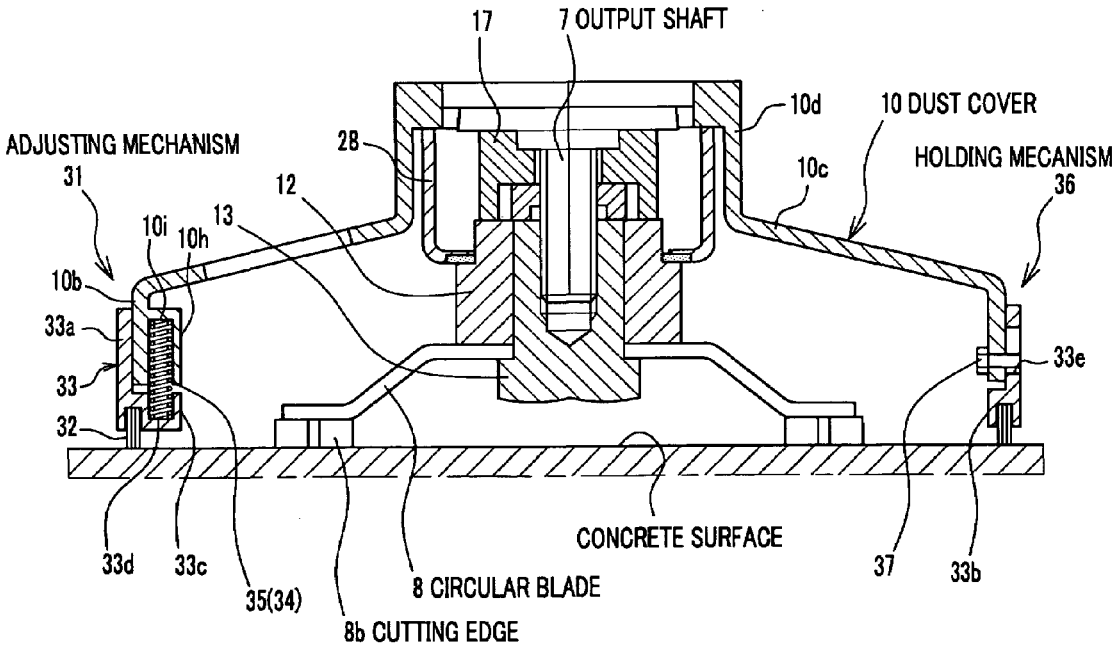
FIG. 7B is a side sectional view illustrating the adjusting mechanism of the sander according to the present invention during touching the workpiece.

In FIGS. 7A and 7B, for convenience, the adjusting mechanism 31 is shown at the left of the dust cover in the drawing, and the holding mechanism 36, at the right.

FIG. 7A shows a condition prior to cutting operation in which the brush holder 33 is downwardly (in the drawing) energized by energizing force of the helical compression spring 35 (spring-loaded). Thus, the brush holder 33 is downwardly positioned apart from the dust cover 10.

During this operation, a position of the brush holder 33 is determined by contact of the external threads 37 with the upper end of the guide holes 33.

Inside the dust cover 10, the cutting edges 8*b* of the circular blade 8 locate at an upper position than that of the lower end of the brush 32. FIG. 7A shows the case that the tips of the cutting edges 8*b* locate at substantially the same height as the lower end of the brush holder 33. In this case, in the conventional sander, because a distance in height between the lower end of the brush 32 and the tips of the cutting edges 8*b* is too large, so that the cutting operation is substantially impossible in this condition.

Here, to adjust the height a spacer might be provided between the adjuster ring 12 and the circular blade 8 or there might be provided adjuster rings 12 having different heights designed to have a function of the spacers. However, when a circular blade 8 is replaced with another circular blade 8 having a different height, the corresponding spacer or adjuster ring having the function of the spacer should be replaced, which is inconvenient.

On the other hand, according to the present invention, as shown in FIG. 7B, when the brush 32 is pressed onto a surface of concrete or the like during the cutting operation, a reaction force from the surface of concrete against the pressure increases gradually, so that the brush 32 (brush holder 33) slides upwardly in accordance with the reaction force against the pressure.

More specifically, the lower end of the brush 32 moves automatically along the axial direction of the output shaft 7 in accordance with the reaction force against the pressure received from the surface of concrete. This provides the same height of the lower end of the brush 32 as the cutting edges 8*b* of the circular blade 8. This enables cutting by the cutting edges 8*b* and prevents powder dust from scattering outside the dust cover 10 with the brush 32.

Further, FIG. 7B shows the condition that the energizing force or spring load force generated by the helical compression spring 35 equals to the reaction force against the pressure. In this condition, when an operator lifts the sander, the energizing force generated by the helical compression spring 35 becomes larger than the reaction force against the pressure, which causes the brush holder 33 to move downwardly.

FIGS. 7A and 7B show conditions where the circumference wall 10*b* of the dust cover 10 and the guide wall 33*a* of the brush holder 33 are in contact with each other. However, in fact, a slight gap for relief is provided therebetween. Thus, the brush holder 33 can be slightly inclined to the dust cover 10 by the distance of the gap.

Further, since a plurality of the helical compression springs 35 are provided in the circumference direction of circumference wall 10*b*, when the sander is pressed to a concrete surface at an angle, the brush holder 33 inclines so as to follow the inclination.

Therefore, no partial gap is formed between the concrete surface and the dust cover 10, which prevents powder dust from being externally scattered and provides air-tightness regarding the sucking force generated by the fan 14.

As mentioned above, the adjusting mechanism 31 is provided around the opening edge 10*a* of the dust cover 10 to enable the contact edge (the lower end of the brush 32) to touch a workpiece such as a concrete surface to move the brush holder 33 automatically along the axial direction of the output shaft 7 in accordance with a reaction force against the pressure received from the object. Thus, the dust cover 10 having only one set of design sizes allows the bodies 1 having different lengths in the output shaft 7 and the circular blades 8 having different heights to be used.

Further, the adjusting mechanism 31 automatically absorbs the difference in height between the side of the brush 32 (the side of the dust cover 10) and the side of the disk cutter 8. This eliminates operation of replacing the spacer.

Further, the adjusting mechanism 31 is provided with the surface touching member (brush holder 33) having the brush 32 movable (slidable) along the axial direction of the output shaft 7, and the energizing means 34 always energizing the surface touching member 33 toward the object side, in which the surface touching member reciprocally shifts in accordance with the magnitude relation between the energizing force by the energizing means 34 and the reaction force against the pressure. This provides the adjusting mechanism 31 with a simple structure.

Further, as the energizing means 34, in addition to the helical compression spring 35, for example, a bellows structure having elasticity, or a similar configuration can used.

As shown in FIG. 1, in the sander A according to this embodiment, the dust discharging sleeve 5 which is a part of the dust discharging unit 3 is arranged adjacent to the side of the body 1, and a part containing the fan 14 is located on the upper part of the dust cover 10. Thus, the dust discharging sleeve 5 tends to interfer with the body 1. Then, as shown in FIG. 2, between the body 1 and the dust cover 10, a spacer 38 is provided to prevent the physical interference between the body 1 and the dust discharging sleeve. This differentiates the height of the body 1 along the output shaft 7 from that of the discharging sleeve 5, which prevents the interference therebetween.

In a cutting operation, replacement of the body 1 is less frequent than the case that the circular blade 8 is replaced with respect to the dust cover 10. Therefore, the structure including the spacer 38 does not affect the cutting operation.

As shown in FIG. 3 or 5, inside the dust cover 10, there is provided an inner cover 28 covering the pulley 17 fixed to the output shaft 7, the endless belt 22 engaged with the pulley 17 and having a through hole 28*a* allowing the output shaft 7 or a rotation member fixed to the output shaft 7 to protrude from the inner cover 28 therethrough. In this embodiment, the inner cover 28 is fit into the protruding section 10*d* so as to cover also the pulley 21 to seal the whole of the first power transmission section 16A and detachably fixed to the dust cover 10 with a screw 29 (see FIG. 5). The edge of the opening in the inner cover 28 touches the inner surface of the protruding section 10*d*.

Further, in this embodiment, as mentioned above, the output shaft 7 is provided with the adjuster ring 12 (corresponding to the above-described rotation member), and thus the through hole 28*a* allows the adjuster ring 12 to protrude from the inner cover 28 therethrough. Thus, the inner diameter of the through hole 28*a* is made larger than that of the outer diameter of the adjuster ring 12.

Here, in the case that the output shaft 7 protrudes through the through hole 28*a* itself (without the adjuster ring 12), the inner diameter of the through hole 28*a* has such a size that the output shaft 7 can be inserted.

The inner cover 28 has a function of blocking power dust filled inside the dust cover 10 during cutting. This prevents powder dust from sticking to the pulleys 17 and 21 and the endless belt 22.

However, in fact, a gap around the adjuster ring 12 tends to allow powder dust to enter the inside the inner cover 28.

According to the present invention, the gap around the adjuster ring 12 is sealed or closed with a seal member comprising felt to prevent powder dust to enter the inside through the gap. The felt is made by densification of wool to have a sheet configuration as described, for example, in the JIS (Japanese Industrial Standard) industrial term dictionary.

As shown in FIG. 5, an annular seal member 30 made of felt is mounted on the inner edge of the through hole 28*a*. The inner circumferential edge of the seal member 30 touches an outer circumferential surface of the adjuster ring 12. This prevents powder dust from entering the inside of the inner cover 28 by sealing the gap in the through hole around the adjuster ring 12.

The seal member 30, partially covering the through hole 28*a*, fixed to the inner cover 28 around the through hole 28*a*, is a member touching the circumferential surface of the rotation member rotating such as the output shaft 7 and the adjuster ring 12 or the like. Here, the seal member 30 comprises felt, which provides a higher flexibility than the case that the seal member was formed with rubber or plastic. More specifically, the felt has a low friction against a metal surface (a surface of the output shaft 7 or the adjuster ring 12), but rather higher friction against dust because of fibers in the felt. Further, the felt is suitably deformable to fit a surface configuration of the output shaft. Further, in addition to felt, a block comprising fibers can be used. Thus, the contact part of the seal member 30 comprising felt with the outer circumferential surface of the adjuster ring 12 or the like fits to the configuration of the circumferential surface. This provides a superior sealing characteristic, a superior heat resistivity against rotation friction, and a superior wear resistance against the rotation friction.

The seal member 30 is fixed to circumference of the through hole 28*a* with an adhesive or a structure in which a groove is formed around the inner circumference of the through hole 28*a*, and the seal member 30 is fit into the groove. However, the seal can be fixed to the side of the output shaft 7.

Second Embodiment

Figure 8:
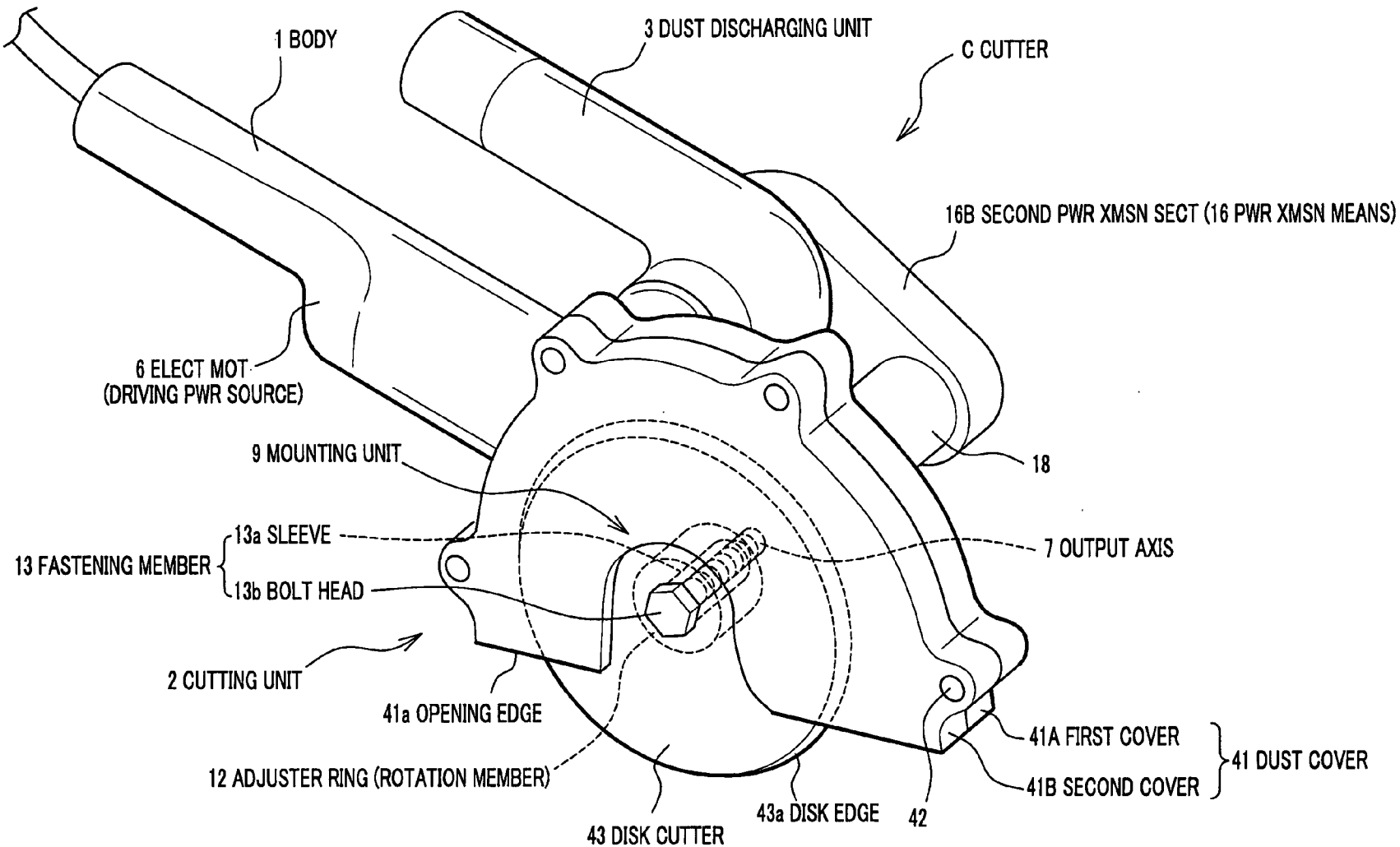
FIG. 8 is a perspective view of a cutter according to the present invention.
Figure 9:
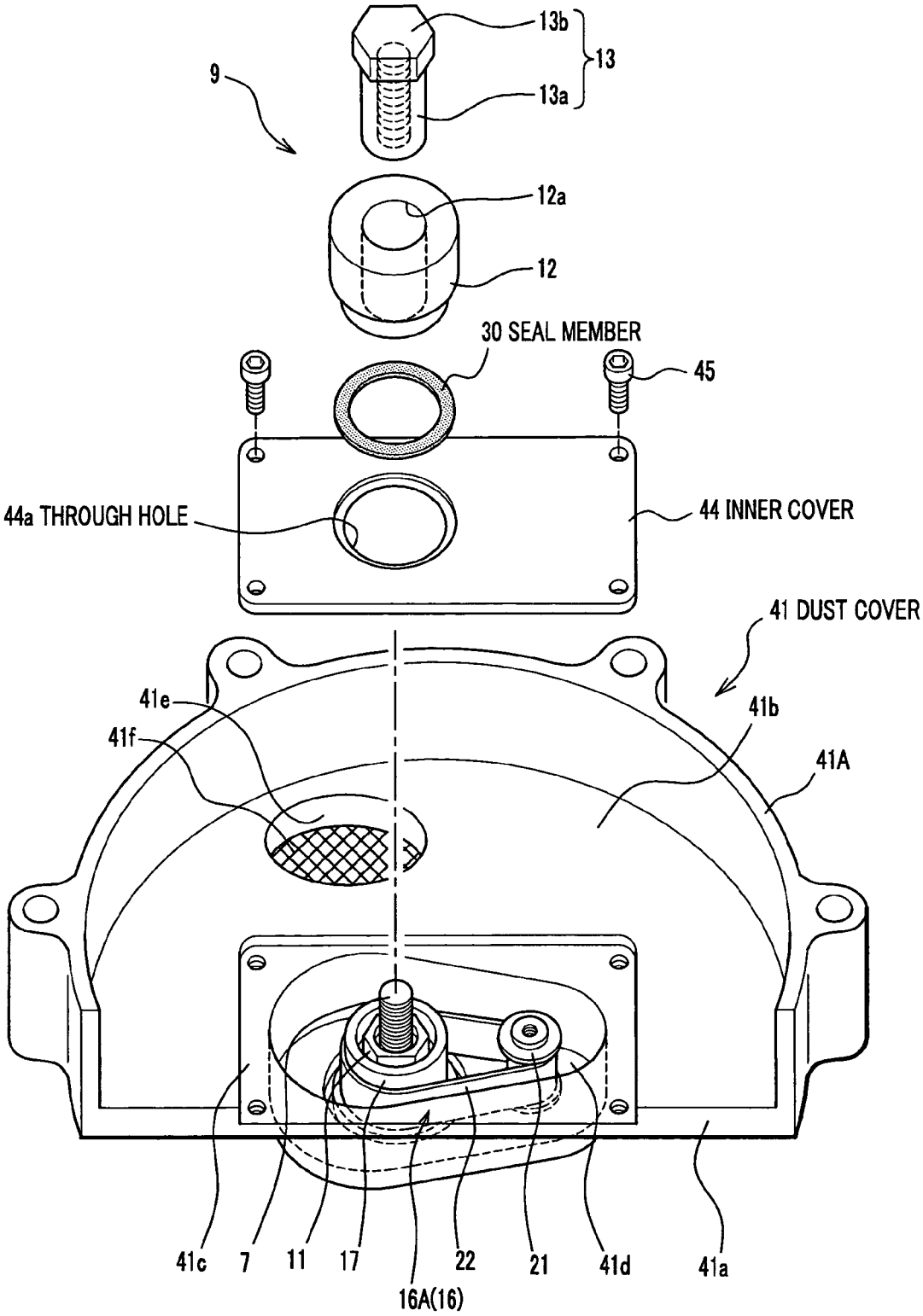
FIG. 9 is a perspective view illustrating a structure inside the dust cover of the cutter according to the present invention.

FIGS. 8 and 9 illustrate a second embodiment of a cutter. FIG. 8 is a perspective view of the cutter, and FIG. 9 is a partial perspective view illustrating a de-assembled condition, wherein a second cover, mentioned later, is removed.

In this embodiment, the same members as those described in the first embodiment are designated with the same references. Descriptions about portions other than the main portion will be omitted in the following description.

In the hand-held cutter C, a body 1 including the electronic motor 6 is so inclined that the axial direction of an output shaft 7 extends in the horizontal direction, and the tip of the output shaft 7 enters the inside of a dust cover 41 of the cutting unit 2.

The dust cover 41 is provided with an opening edge 41*a* facing a workpiece. An outline configuration viewed from the axial direction of the output shaft 7 is substantially a semi-circle in which the opening edge 41*a* corresponds to the side of the semi-circle.

The dust cover 41 is dividable into a first cover 41A and a second cover 41B in the axial direction of the output shaft 7 which are combined with a plurality of bolts 42 as a unit of the dust cover 41. The first cover 41A and the second cover 41B are molded with aluminum alloy by casting or the like.

The dust cover 41 contactlessly covers a circular blade 43 and a mounting member for detachably mounting the circular blade 43 on the output shaft 7. The circular blade 43 has a flat disk configuration provided with a cutting edge 43*a* at the circumferential edge thereof, or a conical cap configuration having a relative low height which is mounted on the output shaft 7 and arranged vertically within the dust cover 41, of which lower circumference protrudes from the opening edge 41*a*.

Regarding a mounting member 9, for example, the same structure as the mounting member of the first embodiment is sufficient, in which the circular blade 43 is mounted on the output shaft with an adjuster ring 12 by a fastening member 13.

As shown in FIG. 9, inside the first cover 41A, a side surface 41*b* of the first cover 41A is provided with a hollow part 41*c* having a rectangular form. The hollow part 41*c* is provided with a hollow power transmission section containing compartment 41*d*. The output shaft 7 is exposed in the power transmission section containing compartment 41*d* in which the pulley 17 is fixed to the output shaft by the nut 11.

Further, the endless belt 22 is wrapped between the pulleys 17 and 21 to transmit the rotation force to the discharging unit section 3 (see FIG. 8). This structure is the same as the structure as the first power transmission section 16A shown in FIG. 5.

Further, in the side surface 41*b* of the first cover 41A, a dust discharging hole 41*e* facing the dust discharging unit 3 is formed in which a dust net 41*f* is also mounted thereto for the same reason mentioned in the first embodiment to prevent larger dust particles from entering the dust discharging unit 3.

The size of the mesh of the dust net 41*f* is determined so as to stop entrance of dust particles having such a size as to stop the rotation of the fan in the dust discharging unit 3 (not shown in FIG. 8).

To cover the first power transmission section 16A, an inner cover 44 having a flat square configuration is fit into the hollow section 41*c* and fixed to the first cover 41A with a plurality of bolts 45. Further, the seal member 30 comprising felt is provided to seal the gap around the adjuster ring 12 in the though hole 44*a*.

The function of the seal member 30 is the same as that of the first embodiment. The advantageous effects mentioned above regarding the seal member 30 described in the first embodiment are also provided.

In FIG. 9, the inner cover 44 is used to cover the first power transmission section 16A. However, the inner cover 28 may be used instead of the inner cover 44. In this case, the inner cover 28 (see FIG. 5) is fit into the power transmission section containing compartment 41*d* so as to cover the pulley 21 to seal the whole of the first power transmission section 16A and detachably fixed to the dust cover 41 with the screw 29 (see FIG. 5), and a corresponding internal screw hole (not shown) in the dust cover 41. The edge of the opening in the inner cover 28 touches the bottom surface of the power transmission section containing compartment 41*d*.

If the output shaft 7 protrudes through the through hole 28*a* with the adjuster ring 12, the inner diameter of the through hole 28*a* has such a size that the output shaft 7 with the adjuster ring 12 can be inserted if the adjuster ring 12 is used.

The inner cover 28 has the function for blocking power dust filled inside the dust cover 41 during cutting. The seal member 30 fixed to the through hole 28*a* is a member touching the circumferential surface of the rotation member rotating such as the output shaft 7 and the adjuster ring 12 or the like. This prevents powder dust from sticking to the pulleys 17 and 21 and the endless belt 22. The seal member 30 is fixed to the inner cover 28 around the through hole 28*a*. In other words, the seal member 30 has a through hole therein allowing at least one of the output shaft 7 and the adjuster ring 12 to protrude therethrough and is fixed to the inner cover 28 around the through hole 28*a* of the inner cover 28, the through hole in the seal member 30 being slidable relative to the output shaft 7.

As mentioned above, preferred embodiments have been described. However, a layout, a shape, and the numbers of respective elements are not limited to those shown in the drawings. Particularly, as the pushing mechanism in the adjusting mechanism, plate springs, hinge springs, or rubber members are applicable.

What is claimed is:

1. A hand-held cutting apparatus comprising:

a body including a driving power source and an output shaft coupled to the driving power source;

a cutting unit mounted on the body including;

mounting means for detachably mounting a circular blade on the output shaft; and a dust cover including an opening edge facing a side of an object for cutting, wherein the dust cover covers the circular blade and the mounting means;

a dust discharging unit attached to the cutting unit for sucking dust particles within the dust cover and externally discharging the dust particles;

a pulley fixed to the output shaft engaged with a flat belt for transmitting power at the output shaft to the dust discharging unit;

an inner cover, including a through hole allowing at least one of the output shaft and a rotation member fixed to the output shaft to protrude from the inner cover therethrough, arranged in the dust cover, for covering the flat belt and the pulley; and a seal comprising felt for sealing a gap between at least one of the output shaft and the rotation member and the through hole, wherein the seal prevents the dust particles from entering the side of the pulley.

2. The hand-held cutting apparatus as claimed in claim 1, wherein the seal has a through hole allowing at least one of the output shaft and the rotation member to protrude therethrough and is fixed to the inner cover around the through hole in the inner cover, the through hole in the seal being slidable relative to the output shaft.

3. The cutting apparatus as claimed in claim 1, further comprising an adjuster ring fixed to the output shaft for adjusting a height of the circular blade relative to the dust cover, wherein the adjuster ring has a diameter larger than that of the pulley, and the adjuster ring and the pulley are fixed to the output shaft, and wherein an area encompassing a difference in the diameter between the adjuster ring and the pulley functions as a guard for preventing the flat belt from detaching from the pulley.

4. The cutting apparatus as claimed in claim 1, further comprising a spacer between the body and the dust cover to prevent interference between a part of the dust discharging unit and the body for differentiating the body and the dust cover in height.

5. The hand-held cutting apparatus as claimed in claim 1, further comprising an adjusting mechanism including a contact edge member contactable with the object around an opening edge of the dust cover for making the contact edge member movable along an axial direction of the output shaft in a predetermined range in accordance with a reaction force received from the object.

6. A hand-held cutting apparatus comprising:

a body including a driving power source and an output shaft coupled to the driving power source;

a cutting unit comprising;

mounting means for detachably mounting a circular blade on the output shaft; and a dust cover comprising an opening edge facing an object for cutting, wherein the dust cover covers the circular blade and the mounting means;

a dust discharging unit attached to the cutting unit for sucking dust particles within the dust cover and externally discharging the dust particles;

an adjusting mechanism comprising a contact edge member contactable with the object around the opening edge of the dust cover for making the contact edge member movable along an axial direction of the output shaft in accordance with reaction force received from the object; and a pulley fixed to the output shaft engaged with a flat belt for transmitting power at the output shaft to the dust discharging unit, and an adjuster ring fixed to the output shaft for adjusting a height of the circular blade, wherein the adjuster ring has a diameter larger than that of the pulley, wherein an area encompassing a difference in the diameter between the adjuster ring and the pulley functions as a guard for preventing the flat belt from detaching from the pulley.

7. The cutting apparatus as claimed in claim 6, wherein the adjusting mechanism comprises a surface touching member, including the contact edge member, movable along the axial direction of the output shaft and a pushing mechanism for always pushing the surface touching member toward a side of the object, wherein the pushing mechanism comprises a structure reciprocally movable in accordance with a relation in magnitude between a pushing force of the pushing member and the corresponding reaction force received from the object.

8. The cutting apparatus as claimed in claim 6, further comprising a spacer between the body and the dust cover to prevent interference between a part of the dust discharging unit and the body.

9. A hand-held cutting apparatus comprising:

a body including a driving power source and an output shaft coupled to the driving power source;

a cutting unit comprising;

mounting means for detachably mounting a circular blade on the output shaft; and a dust cover comprising an opening edge facing an object for cutting, wherein the dust cover covers the circular blade and the mounting means;

a dust discharging unit attached to the cutting unit for sucking dust particles within the dust cover and externally discharging the dust particles;

an adjusting mechanism comprising a contact edge member contactable with the object around the opening edge of the dust cover for making the contact edge member movable along an axial direction of the output shaft in accordance with reaction force received from the object; and wherein the adjusting mechanism comprises a surface touching member, including the contact edge member, movable along the axial direction of the output shaft and a pushing mechanism for always pushing the surface touching member toward a side of the object, wherein the pushing mechanism comprises a structure reciprocally movable in accordance with a relation in magnitude between a pushing force of the pushing member and the corresponding reaction force received from the object, said apparatus further comprising a pulley fixed to the output shaft engaged with a flat belt for transmitting power to the dust discharging unit; and an adjuster ring fixed to the output shaft for adjusting a height of the circular blade, wherein the adjuster ring has a diameter larger than that of the pulley, wherein an area encompassing a difference in the diameter between the adjuster ring and the pulley functions as a guard for preventing the flat belt from detaching from the pulley.

10. The cutting apparatus as claimed in claim 9, further comprising a spacer between the body and the dust cover to prevent interference between a part of the dust discharging unit and the body.

* * * * *